US006352038B1

(12) United States Patent
Nelson et al.

(10) Patent No.: US 6,352,038 B1
(45) **Date of Patent: *Mar. 5, 2002**

(54) MODULAR WORKTOPS, METHOD OF ASSEMBLY, AND METHOD OF USE THEREFOR

(75) Inventors: Thomas John Nelson, Belton; Peter Charles Gaa, Temple; Yein Ming Lee, Temple; Bruce Rodney Trethewey, Jr., Temple, all of TX (US); Peter Fyler Lynch; Scott Warren Osiecki, both of Skaneateles, NY (US); Ronald James Kingston, Camillus, NY (US)

(73) Assignee: Premark RWP Holdings, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/652,215

(22) Filed: Aug. 30, 2000

Related U.S. Application Data

(63) Continuation of application No. 09/256,259, filed on Feb. 23, 1999, now Pat. No. 6,131,521, which is a continuation-in-part of application No. 09/193,910, filed on Nov. 17, 1998, now abandoned.

(51) Int. Cl.[7] ..... A47B 17/00
(52) U.S. Cl. ..... 108/27; 312/140.3; 52/782.24
(58) Field of Search ..... 108/27, 42, 90, 108/102, 137; 312/140.1, 140.3, 140.4; 52/782.2, 782.23, 782.24, 795.11, 795.12, 797.1, 578, 582.1, 802.1, 802.11; 403/381; 248/419, 420, 244

(56) References Cited

U.S. PATENT DOCUMENTS

| | | | |
|---|---|---|---|
| 2,475,112 | A | 7/1949 | Stanitz |
| 2,489,493 | A | 11/1949 | Kuenzie |
| 2,539,463 | A | 1/1951 | Norquist |
| 2,586,112 | A | 2/1952 | Stoddard |
| 2,594,516 | A | 4/1952 | Swisher |
| 2,646,326 | A | 7/1953 | Stanitz |
| 2,654,648 | A | 10/1953 | Burke |

(List continued on next page.)

FOREIGN PATENT DOCUMENTS

| | | |
|---|---|---|
| CA | 719619 | 10/1965 |
| DE | 8533438 | 1/1986 |
| DE | 3843548 | 6/1990 |
| DE | 19714052 | 10/1998 |
| EP | 169572 | 1/1986 |
| EP | 834269 | 4/1998 |
| FR | 407772 | 10/1909 |
| GB | 1310778 | 3/1973 |
| GB | 2094140 | 9/1982 |
| GB | 2232586 | 12/1990 |
| GB | 2246701 | 2/1992 |
| JP | 48022167 | 3/1973 |
| NZ | 167948 | 5/1974 |
| TW | 163581 | 7/1991 |
| TW | 300846 | 3/1997 |
| TW | 319329 | 11/1997 |

*Primary Examiner*—Peter M. Cuomo
*Assistant Examiner*—Jerry A. Anderson
(74) *Attorney, Agent, or Firm*—Welsh & Flaxman LLC

(57) ABSTRACT

Disclosed is a modular worktop, and method of assembly, including a surface member, a front edge, and a backsplash, the components preferably being removably attached to each other. Each of the surface member, front edge, and backsplash may be selected from a predetermined group of decorative surfacing options, resulting in a worktop that is aesthetically pleasing to the consumer or person selecting the components. Additionally, each of the components is sized and configured so as to bring assembly and installation within the skill range of the average consumer. Because the front edge is removably attached, the front edge is changeable at the discretion of the consumer, for example, for aesthetic reasons.

12 Claims, 10 Drawing Sheets

U.S. PATENT DOCUMENTS 2,665,183 A 1/1954 Battles
2,688,523 A 9/1954 Norman et al.
2,728,957 A 1/1956 Keller
2,785,938 A 3/1957 Weise
2,845,666 A 8/1958 Knapp
2,956,288 A 10/1960 Nolan
2,970,872 A 2/1961 Ullman, Jr.
2,980,477 A 4/1961 Hansen
3,071,780 A 1/1963 Lyon Jr.
3,101,486 A 8/1963 Tiller
3,192,882 A 7/1965 McFarland et al.
3,219,401 A 11/1965 Mapson
3,585,657 A 6/1971 Jensen et al.
3,752,548 A 8/1973 Betts
4,047,822 A 9/1977 Lehmann
4,126,365 A 11/1978 Bryant
4,201,359 A 5/1980 Baslow
4,206,165 A 6/1980 Dukess
4,221,624 A 9/1980 Eslinger et al.
4,347,793 A 9/1982 Rajnert
4,360,282 A 11/1982 Koch
4,558,553 A 12/1985 Kolk
4,613,995 A 9/1986 Ricke
4,685,879 A 8/1987 Purstinger et al.
4,771,488 A 9/1988 Markham
4,996,817 A 3/1991 Nelson
5,018,628 A 5/1991 Schenck et al.
5,184,886 A 2/1993 Handley
5,253,932 A 10/1993 Nesovic
5,259,691 A 11/1993 Moore et al.
5,260,007 A 11/1993 Efstratis et al.
5,330,262 A 7/1994 Peters
5,402,738 A 4/1995 Carr et al.
5,419,264 A 5/1995 Davis
5,440,857 A 8/1995 Shanok et al.
5,452,666 A 9/1995 Peters
5,470,140 A 11/1995 Schagunn
5,546,708 A 8/1996 Efstratis et al.
5,551,103 A 9/1996 Drozdowich et al.
5,581,957 A 12/1996 Egger Jr. et al.
5,595,126 A 1/1997 Yeh
5,595,427 A 1/1997 Peters et al.
5,722,746 A 3/1998 Hull et al.
5,733,022 A 3/1998 Whetstone
5,754,991 A 5/1998 Drozdowich et al.
5,755,983 A 5/1998 Bordener
5,795,641 A 8/1998 Pauley et al.
5,809,901 A 9/1998 Gutzmer
6,131,521 A * 10/2000 Nelson et al. ..... 108/27

* cited by examiner

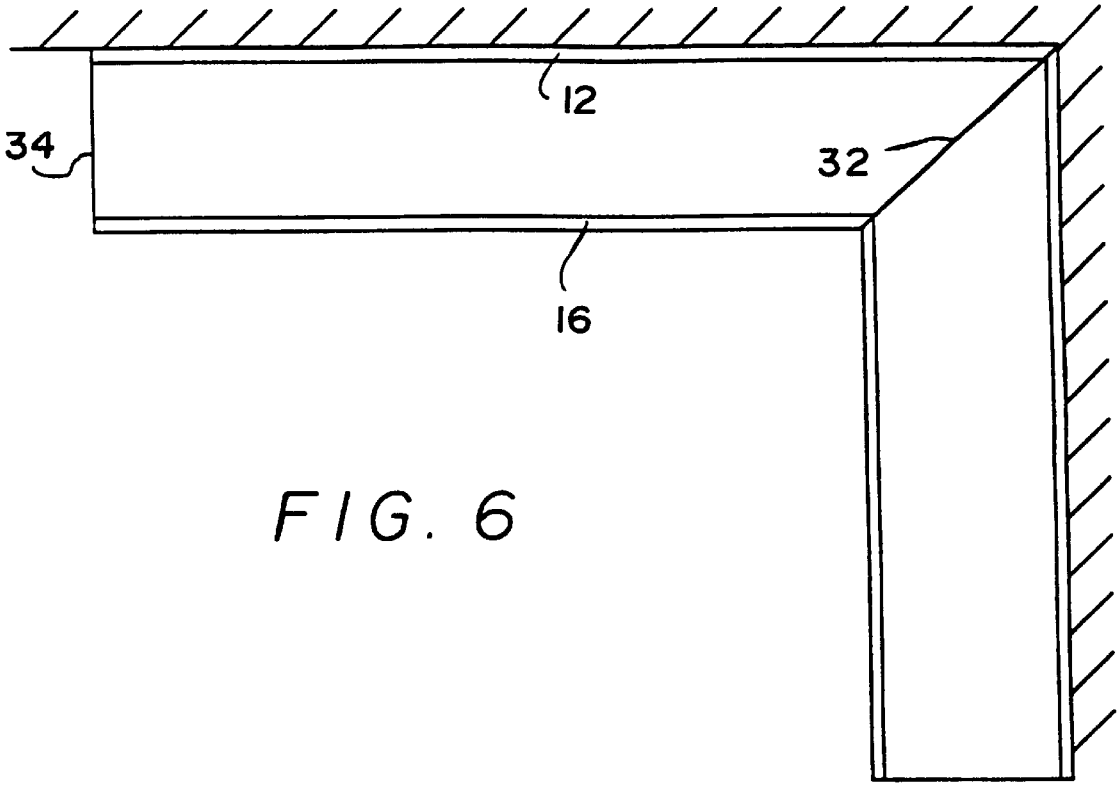
FIG. 6
FIG. 7
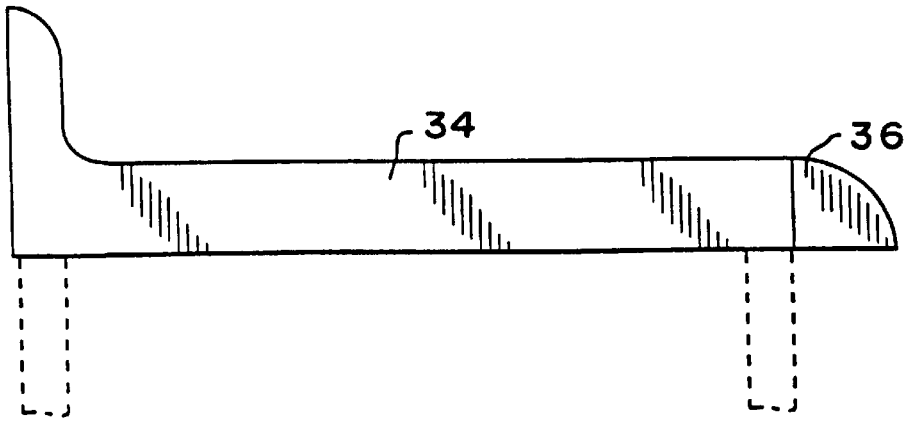

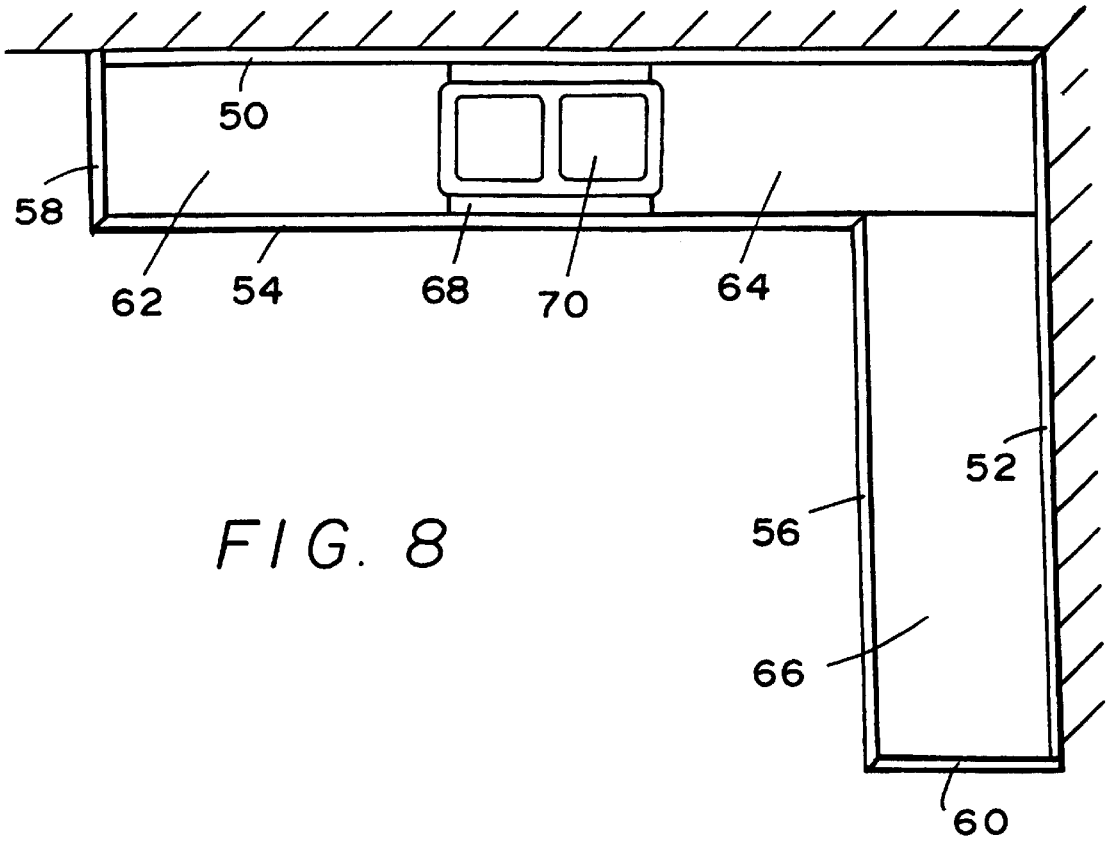
FIG. 8
FIG. 9
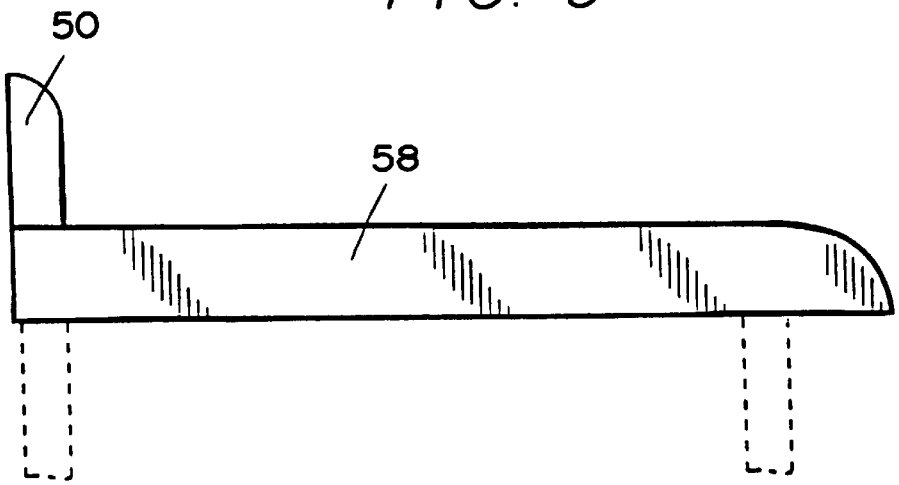

MODULAR WORKTOPS, METHOD OF ASSEMBLY, AND METHOD OF USE THEREFOR

CROSS REFERENCE TO RELATED APPLICATIONS

This application is a continuation of U.S. patent application Ser. No. 09/256,259, filed Feb. 23, 1999, now U.S. Pat. No. 6,131,521 which is a continuation-in-part of U.S. patent application Ser. No. 09/193,910, filed on Nov. 17, 1998 now abandoned.

TECHNICAL FIELD

The present invention relates to decorative surfacing such as worktops, and specifically to modular decorative surfacing. The present invention has further relation to worktops that are easy to install and have removable components that may be replaced permanently or periodically for aesthetic reasons.

BACKGROUND OF THE INVENTION

Worktops, vanity tops, and the like are traditionally made of decorative laminate bonded to a substrate, such as particle board. They are also made of solid polymeric surfacing, wood, metal, and various combinations thereof. Typically, a worktop has a front edge and a backsplash that are permanently fixed to the worktop or are formed integrally to the worktop. Various types of worktops and their construction are well known to those skilled in the art.

When backsplashes and front edges are formed integrally to the worktop, they inherently are of the same decorative surfacing material as the rest of the article; the resulting aesthetic effect is uniform. When backsplashes and front edges of a different aesthetic effect and/or different decorative surfacing material are used in conjunction with a worktop, they are typically permanently fixed to the top either during fabrication of the top or during installation of the top in a home, office, business, or the like. This work is typically done by trained fabricators and is beyond the skill of the average consumer. Additionally, if a consumer eventually decides that he or she does not like the aesthetic combination of front edge, backsplash, and counter surface that were initially chosen, the typical option is to tear out the whole worktop and start over again. Other options include resurfacing by installing new laminate over existing laminate, and routing out the old front edge and installing a new one. The result is a tremendous waste in terms of time, effort, and money. For example, if a consumer contracts with a fabricator for the installation of a white worktop with a white backsplash and blue front edge, then later decides a red front edge would be preferable, the whole worktop must be replaced, or the front edge must be routed out so that a new one may be installed.

There exists a need then for a modular worktop that is easily assembled from components of differing sizes and decorative surfacing options, so that a consumer may assemble and install the worktop, as well as "mix and match" various types and styles of components. There also exists a need for an easy way to assemble these components that is within the realm of the skill of the average consumer. There also exists a need for components that are replaceable at the discretion of the consumer. The objects of the present invention are to fill these unmet needs, and these and other objects of the invention will become apparent through the specification, claims, and drawings provided herein.

SUMMARY OF THE INVENTION

Disclosed is a worktop including a surface member, a front edge, and a backsplash, the front edge and backsplash being attached to the surface member, and at least the front edge being removably attached to the surface member. The removable attachment device may be a centric sphere connector. Each of the surface member, front edge, and backsplash are selected from a predetermined group of decorative surfacing options. At least one of the front edge and backsplash may be a different decorative surfacing option from the surface member.

Also disclosed is a method of assembling a worktop including the steps of selecting a surface member from a predetermined group of surface member decorative surfacing options, selecting a front edge from a predetermined group of front edge decorative surfacing options, selecting a backsplash from a predetermined group of backsplash decorative surfacing options, and attaching the backsplash and the front edge to the surface member to form a worktop. At least the front edge is removably attached to the surface member, for example with a centric sphere connector.

The disclosed worktop may be thought of as a multi-component surfacing unit, some or all of the components thereof being removably attached to each other to form a custom selected decorative surfacing unit that is aesthetically pleasing to the consumer or person selecting the components. Some or all of the components may be removably attached to each other with centric sphere connectors, or other attachment means known in the art. Each component may be selected from a predetermined group of decorative surfacing options. At least one component may be a different decorative surfacing option from the remaining components.

Additionally disclosed is a method of using a worktop with a changeable front edge, the method comprising the steps of supplying a plurality of front edge decorative surfacing options, selecting a desired decorative surfacing option from the plurality of options, and removably attaching the selected option to the worktop. The removable attachment member may be a centric sphere connector, or other attachment means known in the art. The front edge decorative surfacing options may include designs that conform to seasons of the year, designs that conform to holidays, or the like.

Also disclosed is a method of assembling a worktop including the steps of providing a plurality of surface member modules of varying lengths, a plurality of backsplashes of varying lengths, and a plurality of front edges of varying lengths, and selecting and assembling components of a size necessary to produce the desired sized worktop. A sink module may also be provided for installation with the surface member modules if a sink is desired in the worktop. The components may be provided already cut to size or may be provided in a few sizes that may need to be cut to size upon assembly and installation.

The components are ideally removably attached to each other for ease of changeover when desired. Removable attachment members such as concentric sphere connectors may be used to attach the components to each other. Where the worktop extends around a ninety-degree corner the components may need to be mitered at the corner. Exposed side edges may be covered with edging that is mitered into the front edge at the corners. The backsplash may be provided with a location for decorative indicia. Each of the components may be provided in a variety of aesthetic designs.

The backsplash may include a sealing member extending the length of the backsplash and located on the back surface proximate to the top surface, a portion of the sealing member extending from the back surface so that upon installation of the backsplash against a wall, the sealing member will come into contact with the wall to fill any gap between the backsplash and the wall to eliminate the necessity for scribing the backsplash into the wall. The joint between the backsplash and the surface member may include a sealing member attached to the worktop at the joint to substantially prevent liquids from penetrating the joint. The joint between the front edge and the surface member may also include a sealing member attached to the worktop at the joint to substantially prevent liquids from penetrating the joint.

BRIEF DESCRIPTION OF THE DRAWINGS

FIG. 6 is a plan view of a worktop installation in accordance with the present invention.

FIG. 7 is an elevational side view of an embodiment of a worktop in accordance with the present invention, showing a finished end.

FIG. 8 is an alternative plan view of a worktop installation in accordance with the present invention.

FIG. 9 is an elevational side view of a finished end in accordance with the worktop installation of FIG. 8.

DETAILED DESCRIPTION OF THE PREFERRED EMBODIMENTS

Detailed embodiments of the present invention are now disclosed. It should be understood, however, that the disclosed embodiments are merely exemplary of the invention, which may be embodied in various forms. Therefore, the details disclosed herein are not to be interpreted as limiting, but merely as the basis for the claims and as a basis for teaching one skilled in the art how to make and/or use the invention.

Figure 1C:
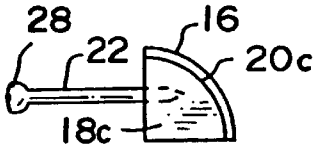
FIG. 1C is an elevational side view of an embodiment of a front edge in accordance with the present invention.
Figure 1B:
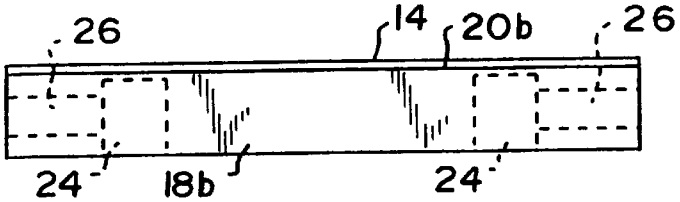
FIG. 1B is an elevational side view of an embodiment of a surface member in accordance with the present invention.
Figure 1A:
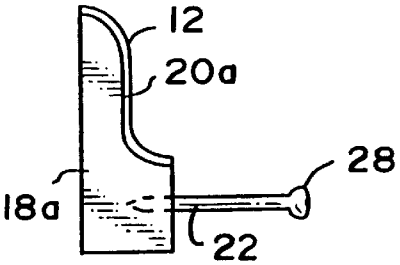
FIG. 1A is an elevational side view of an embodiment of a backsplash in accordance with the present invention.

FIGS. 1A, 1B, and 1C show the typical component parts of a worktop 10, or a countertop, as exemplary of the present invention. FIG. 1A shows a backsplash 12, FIG. 1B shows a surface member 14, and FIG. 1C shows a front edge 16. These components are constructed of typical decorative surfacing materials known in the art, such as high pressure decorative laminate, solid surfacing, solid surfacing veneer, natural and artificial stone compositions, low or direct pressure laminates, metal foils, wood veneers, and the like. These materials may or may not require use of a substrate in conjunction with the decorative layer; such substrates known to the art are fiberboard, particleboard, foamed polymers, wood, and the like. The presently described embodiment, as exemplary, consists of particle board substrate 18*a*, 18*b*, and 18*c*, affixed to a high pressure decorative laminate (HPDL) surface layer 20*a*, 20*b*, and 20*c*.

Each of components 12, 14, and 16 may be supplied in a variety of different colors, materials, surface textures, etc., backsplash 12 and front edge 16 may be supplied in various profile configurations, and the components may be supplied in a variety of lengths. For example, a consumer may have a need for a worktop ten feet in length to install in the consumer's home. The consumer may want, for example, a surface member 14 with white HPDL along with a backsplash 12 and front edge 16 with blue HPDL. The consumer would then purchase each of components 12 and 16 in blue and in ten foot lengths, and component 14 in white and in a ten foot length, for subsequent assembly and installation in the home. The decorative combinations of components 12, 14, and 16 could just as easily be HPDL and wood, solid surfacing veneer and metal, etc.

The components may then be removably attached together with any removable attachment means known to the art. An exemplary attachment means is a centric sphere connector, described in detail below, and supplied by Häfele America Co., of Archdale, N.C. Other such removable attachment means include nuts and bolts, screws, and the like. For example, backsplash 12 and front edge 16 may be attached to surface member 14 via tongue and groove joints. Screws, or other means of securing, may then be inserted through the tongue and groove joint to secure the assembly together.

Typical use of centric sphere connectors in the present invention would include fixing pins 22 into backsplash 12 and front edge 16 as shown in FIGS. 1 through 4, and providing vertical cavities 24 and horizontal cavities 26 in surface member 14. Pins 22 must be fixed into backsplash 12 and front edge 16 so as to withstand tensile stresses on pins 22 during use. Means for fixing pins 22 into a substrate are generally known in the art, and include screw threads in the case of a wood-based substrate, drilling holes and using a bonding agent in conjunction with screw threads in the case of polymeric substrates, and other means known in the art. The locations of pins 22 and cavities 24 and 26, and the size of cavities 24 and 26, must be accurate per the hardware supplier's instructions to insure proper and secure attachment of the components.

Figure 3:
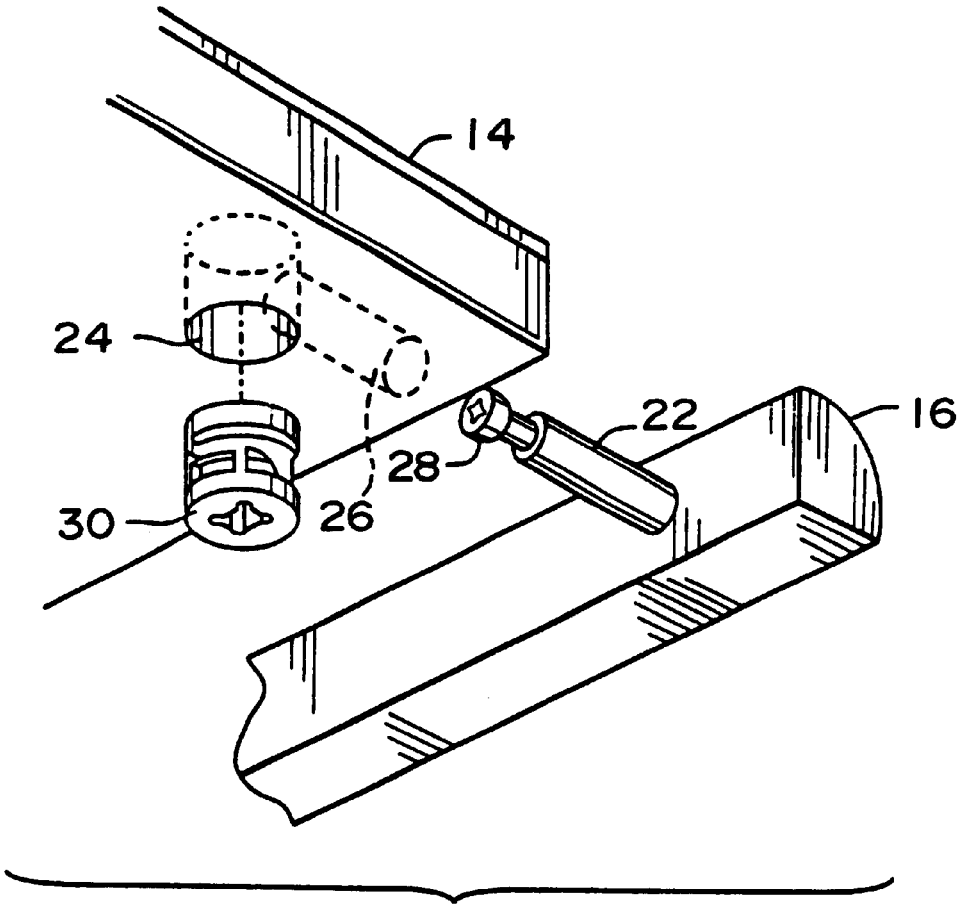
FIG. 3 is a partial perspective view of the underside of the components of a worktop in accordance with the present invention.
Figure 4:
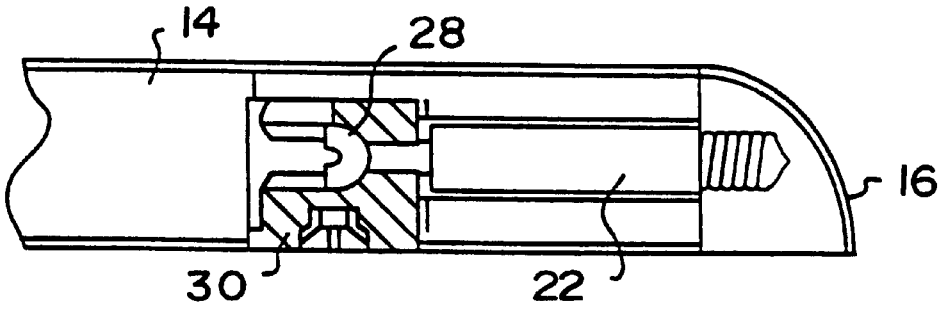
FIG. 4 is an elevational sectional view of an exemplary means for attaching a surface member to a front edge in accordance with the present invention.
Figure 5B:
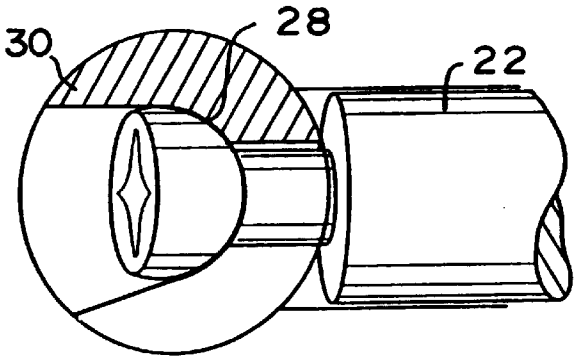
FIG. 5B is an exploded view of the exemplary means for attachment shown in FIG. 4 in the locked position.
Figure 5A:
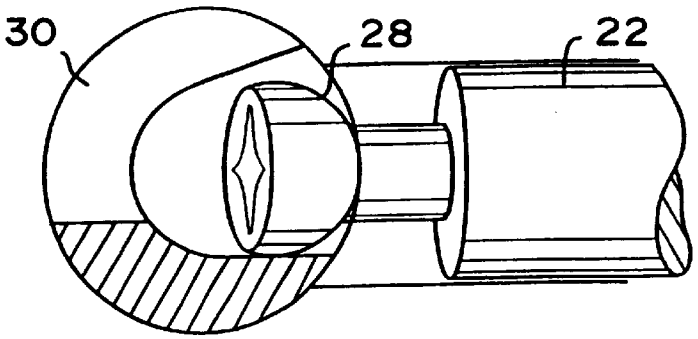
FIG. 5A is an exploded view of the exemplary means for attachment shown in FIG. 4 in the unlocked position.

Referring now to FIGS. 3 and 4, pins 22 are inserted into cavities 26 such that their heads 28 are approximately centrally located within cavities 24. This allows insertion of locking cams 30 into cavities 24 over heads 28. Referring to FIG. 5A, locking cam 30 is provided with a vertical opening that allows it to slide over and encompass head 28. Cam 30 is also provided with a horizontal opening around a portion of its circumference. Referring to FIG. 5B, this horizontal opening allows cam 30, when rotated to the lock position, to grab onto pin 22 and put it into a state of tension. This causes backsplash 12 and front edge 16 to be tightly secured to surface member 14. The positioning of pins 22 and cavities 24 and 26 along the length of the components must be precise and frequent enough to insure accurate and quality assembly of the components.

Referring now to FIG. 6, a typical worktop installation is shown from above; cabinetry is typically located below and supports the worktop, which may be attached to the cabinetry by any method known in the art. A typical miter joint 32 is used where the worktop takes a 90-degree turn; backsplash 12 and front edge 16 would be mitered accordingly, as shown. The miter joint may be connected via concentric sphere connectors.

FIG. 7 shows finished end 34 of FIG. 6. End 34 is typically covered with a piece of HPDL cut to fit the shape of end 34. Because backsplash 12 would generally not be readily removable, the piece of HPDL covering end 34 may include integral coverage for backsplash 12 and surface member 14. Front edge end 36, however, would need to be covered with a separate piece of HPDL so as to facilitate any subsequent removal of front edge 16.

Because front edge 16 is removably attached to surface member 14, front edge 16 may be easily replaced or changed periodically. For example, if the consumer desires a red front edge rather than an existing blue one, a new red front edge may be purchased and installed with minimal cost and effort. Also, a variety of front edges, each with a different design, may be made available to the consumer. If the consumer, for example, wishes to change worktop front edge designs for each holiday season, replaceable front edges may be supplied with Halloween designs, Christmas designs, Fourth of July designs, etc. Alternatively, a set of front edges with summer, winter, spring, and fall designs may be supplied. The removability of the front edge of the present invention facilitates easy changeover for use of such designs by the consumer.

Another embodiment of the present invention contemplates a set of modular components, or a "kit", the assembly and installation of which are within the skill of the average consumer. As shown in FIG. 8, the component parts include lengths of backsplash 50 and 52, lengths of front edge 54 and 56, lengths of side edge 58 and 60, first surface member module 62, second surface member module 64, third surface member module 66, and sink module 68.

The thickness of the backsplash 50 and 52 is standard, as is the depth of surface member modules 62, 64, 66, and 68. This allows for a predetermined standard length of side edges 58 and 60, which may also be supplied pre-mitered for left and right-hand worktop sides. Backsplashes 50 and 52, front edges 54 and 56, and modules 62, 64, and 66 may be supplied in a wide variety of lengths and with pre-mitered ends to facilitate assembly and installation without the need for cutting. Alternatively, these components may be supplied in a few different sizes, thereby requiring the consumer to select sizes slightly longer than necessary for the installation in question and subsequently cutting the individual components to size. Naturally, it is preferable to supply these components in a wide enough variety of lengths to eliminate any need for cutting by the consumer.

Figure 10:
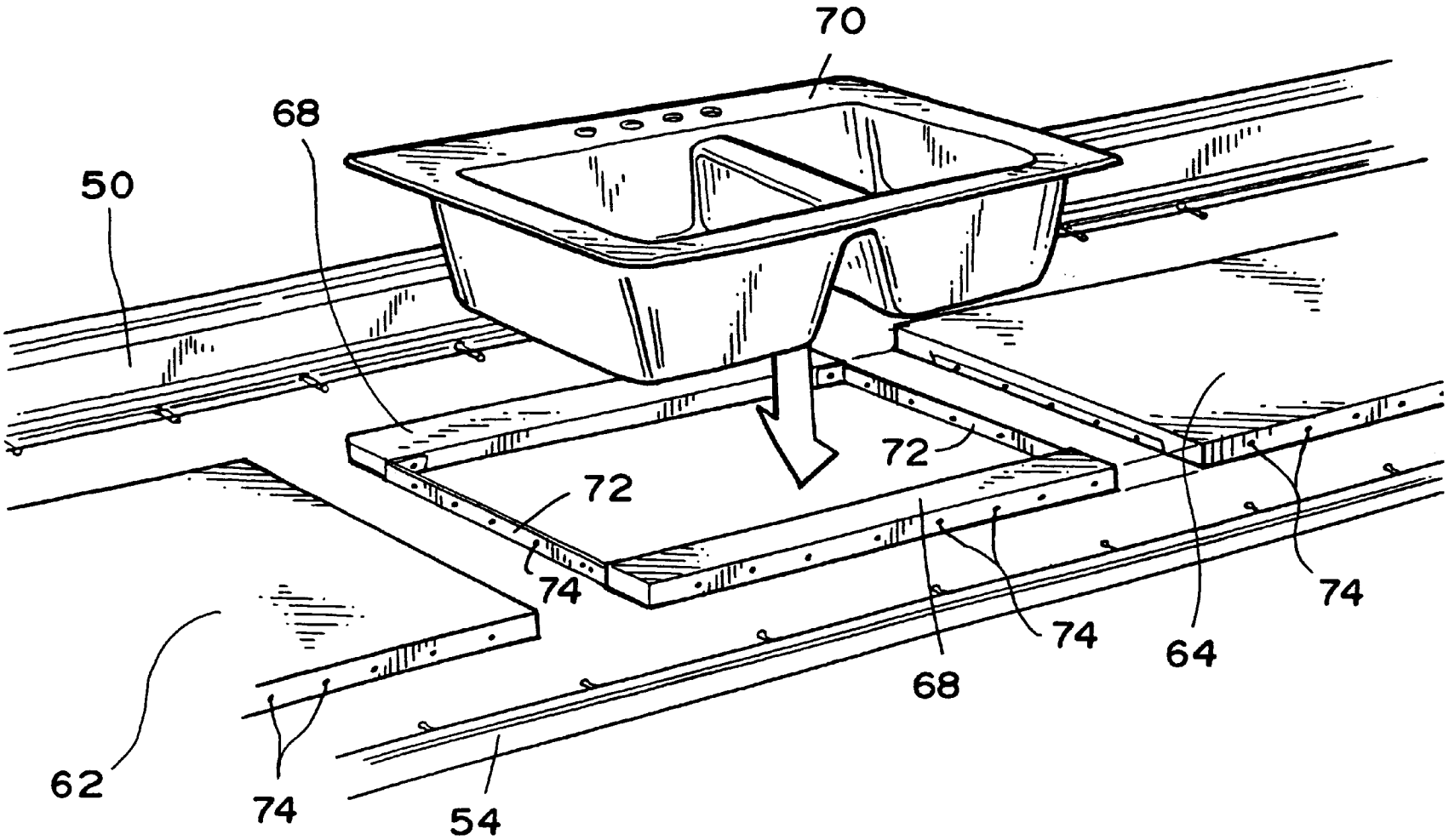
FIG. 10 is an exploded perspective view of a modular worktop in accordance with the present invention, showing a sink module.

Sink module 68, better shown in FIG. 10, may also be supplied in a wide variety of sizes to accommodate various sink sizes and designs. The present invention contemplates the use of drop-in sinks, such as sink 70, to be inserted into sink module 68. Alternatively, sink module 68 may be supplied as a preformed module with integral sink.

Figure 2:
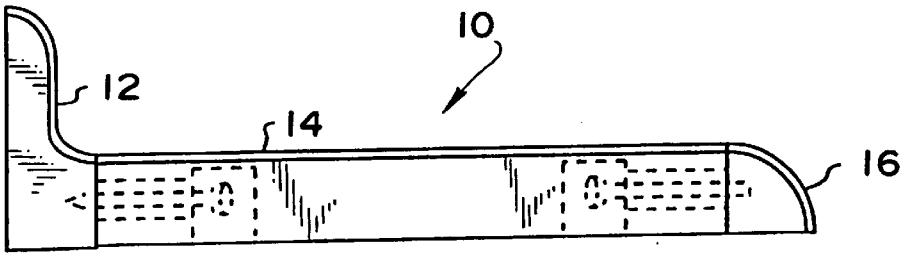
FIG. 2 is an elevational side view of an embodiment of a worktop in accordance with the present invention.

Note the use of connectors 72 in sink module 68 which provide for the width dimension of the hole for sink 70, and also for a means of connecting sink module 68 to adjacent surface member modules 62 and 64. Surface member and sink modules 62, 64, 66, and 68 are provided with channels 74 which correspond to vertical and horizontal channels 24 and 26 as shown in FIGS. 1–3. Channels 74 are equally spaced around the perimeter of the surface members 62, 64, 66, and sink module 68, so as to provide means for necessary and sufficient connection of the component parts to each other. It is contemplated that concentric sphere connectors, such as those shown in FIGS. 1–5 may be used in conjunction with channels 74 to provide for an easy to assemble and easy to disassemble worktop.

Figure 11:
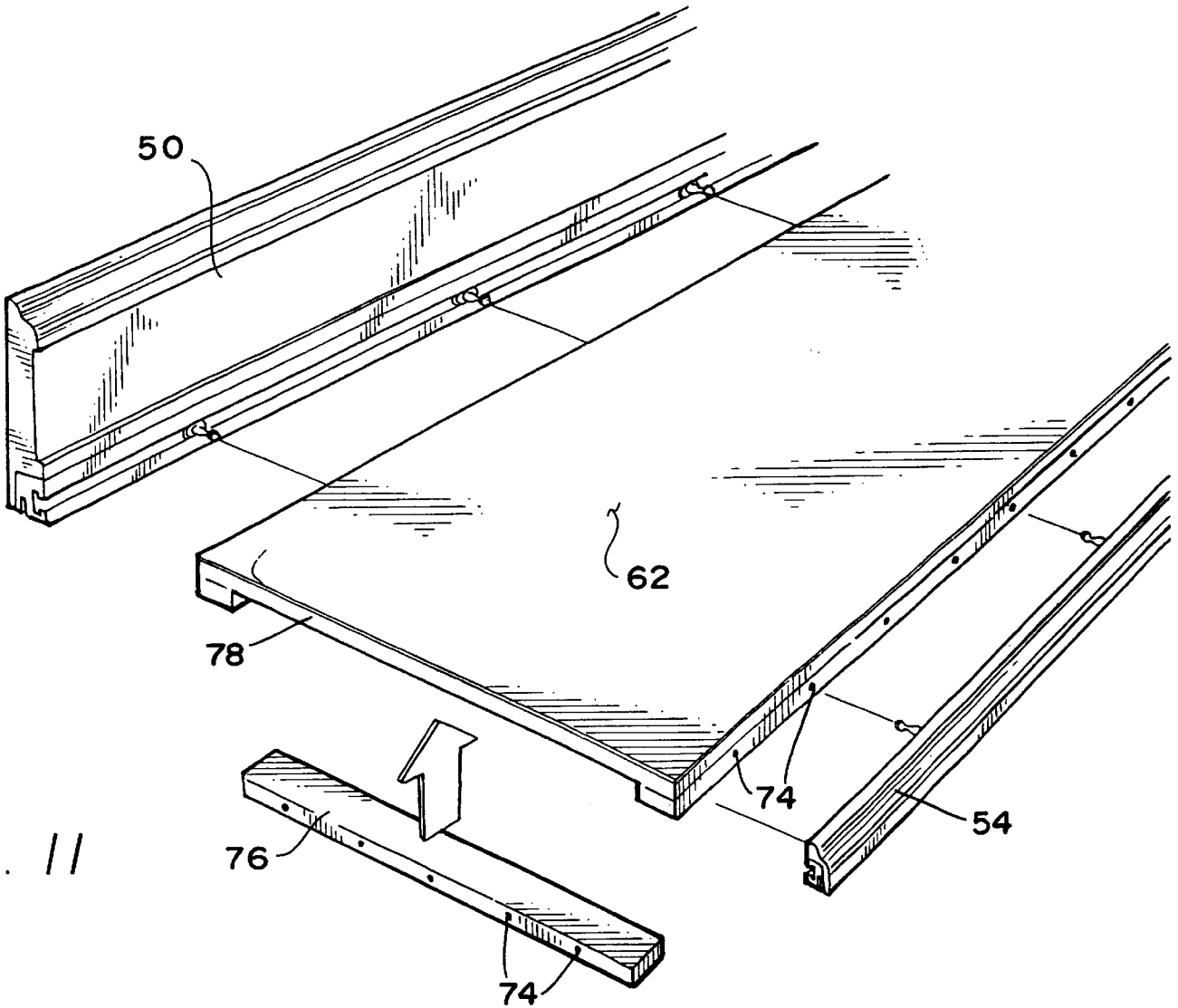
FIG. 11 is an exploded perspective view of a modular worktop in accordance with the present invention, showing various component parts.

If the surface member modules do need to be cut, connecting member 76, shown in FIG. 11, must be supplied to provide means for connecting other component parts of the worktop onto cut end 78. The length of connecting member 76 is standard, as it is dependent upon the standard depth of the surface members. Connecting member 76 may be ideally attached in place with glue and wood screws, or any other means of providing attachment secure enough to withstand the forces exerted upon it through attachment to another component with concentric sphere connectors.

Figure 12:
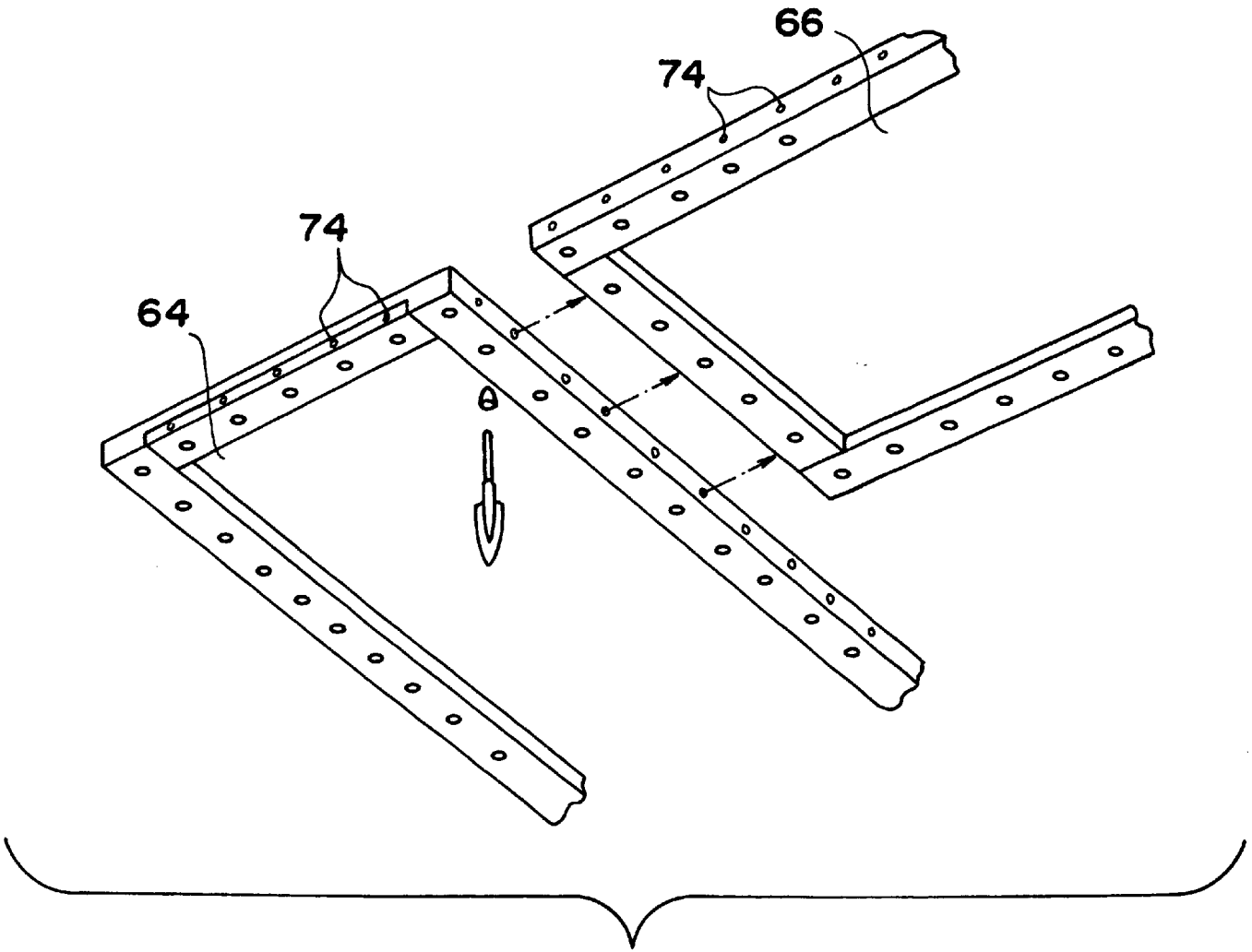
FIG. 12 is an exploded perspective view of a modular worktop in accordance with the present invention, showing module attachment means on the underside of the worktop.
Figure 13:
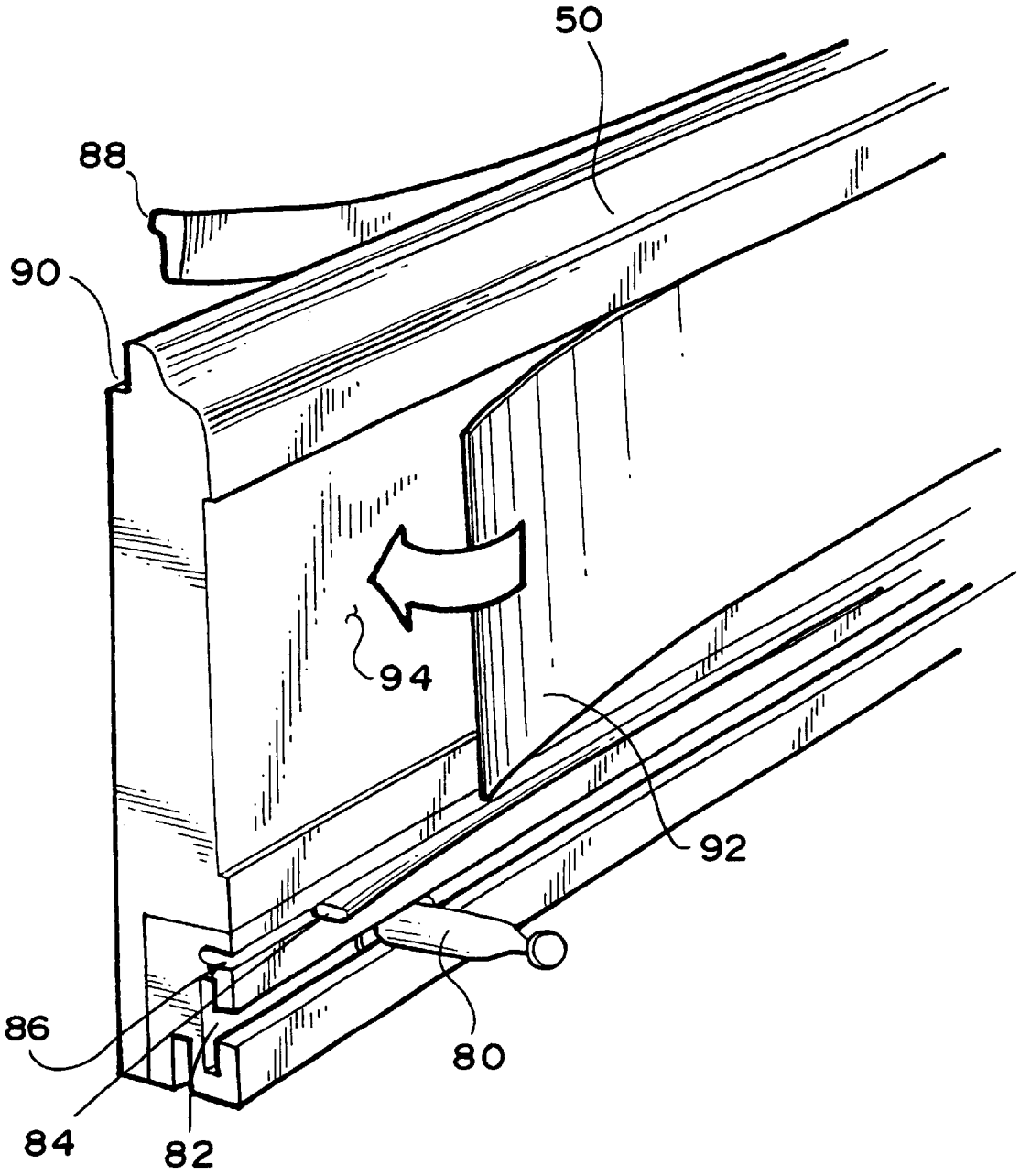
FIG. 13 is an exploded perspective view of a backsplash in accordance with the present invention.
Figure 14:
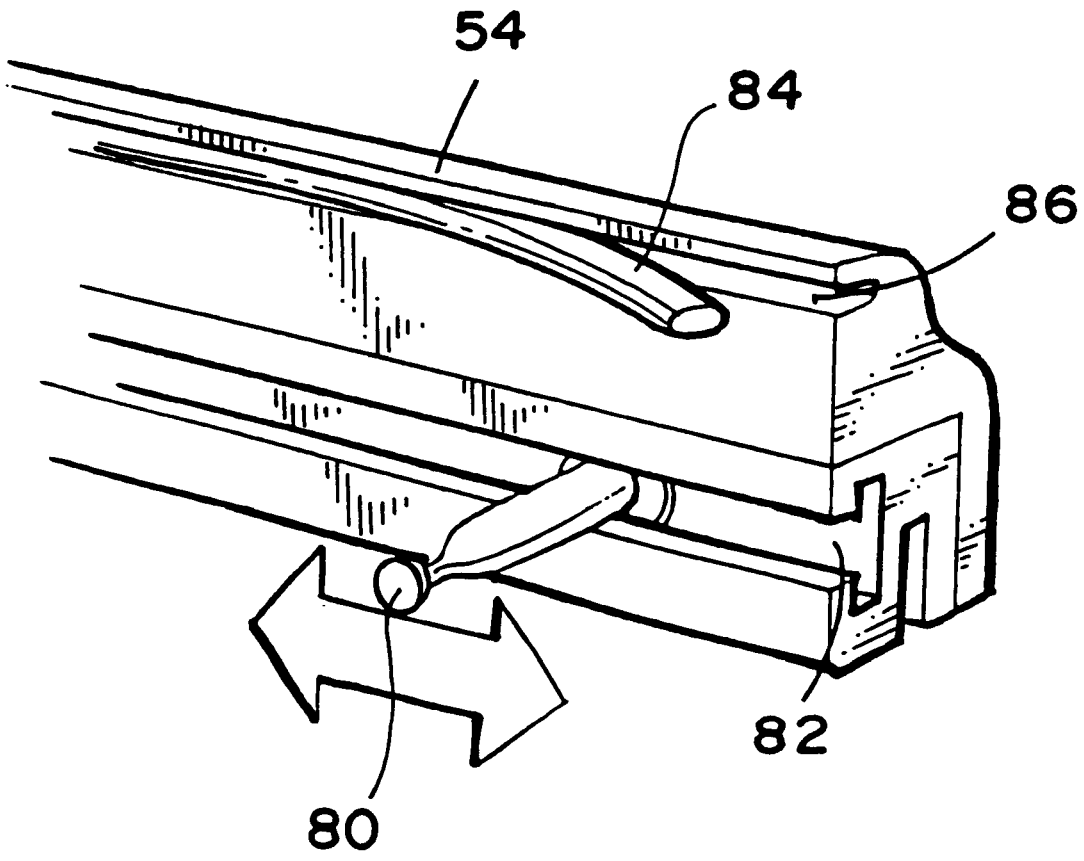
FIG. 14 is an exploded perspective view of a front edge in accordance with the present invention.

FIG. 12 shows the underside of surface member modules 64 and 66, and the use of concentric sphere connectors, as explained above, to connect the two components. FIGS. 13 and 14 show backsplash 50 and front edge 54 respectively. A plurality of pins 80 may be slidably engaged into slots 82 for ease of alignment between pins 80 and channels 74. Sealing members 84 may be inserted into slots 86 to provide for a liquid-tight joint between the components if necessary. Also, sealing member 88 may be inserted into slot 90 so as to fill any gaps between backsplash 50 and the wall. Sealing members 84 and 88 may be caulking compound, rubber gasket strips, or any other similar sealing material.

Sealing member 88 extends beyond the plane of the back of backsplash 50 in order to eliminate the need for scribing backsplash 50 into the wall behind it. Scribing is a process by which a worktop fabricator cuts the contour of the wall into a backsplash to eliminate gaps between the backsplash and the wall. An alternative method is to fill any such gaps with caulking compound, usually a very messy process. Provision of sealing member 88 provides for a quick, clean, and easy method of eliminating gaps between a backsplash and a wall.

Finally, decorative indicia 92 may be supplied for insertion into location 94 on backsplash 50. As discussed above, backsplash 50 may be supplied in a variety of colors and styles. A variety of decorative indicia 92 may also be supplied so that consumers can "mix and match" indicia 92 with backsplashes 50 to their liking. Such indicia 92 may be of the peel and stick type, the glue on type, etc. Once the worktop is installed, decorative indicia 92 may be changed as desired by peeling off the old indicia, and selecting and installing new indicia.

The present invention may also be used in conjunction with an "island" countertop installation. In such an application, no backsplashes are used. Typically, one large surface member is used along with a plurality of edge moldings.

Additional advantages and modifications will be readily apparent to one skilled in the art, while falling within the spirit and scope of the claimed invention. The claimed invention in its broader aspects is not, therefore, limited to the specific examples and structures described above and claimed below. Any such advantages and modifications, while not specifically described herein, are deemed to be within the spirit and scope of the presently disclosed and claimed invention.

What is claimed is:

1. A method of assembling a worktop comprising the steps of providing a plurality of surface member modules of varying lengths each including a surface connecting member, and selecting at least one surface member module of a size necessary to produce the desired sized worktop;

providing a plurality of backsplashes of varying lengths each including a backsplash connecting member, and selecting at least one backsplash of a size necessary to produce the desired worktop;

providing a plurality of front edges of varying lengths, each including a front edge connecting member, and selecting at least one front edge of a size necessary to produce the desired sized worktop, wherein at least one of the surface connecting member, the backsplash connecting member and the front edge connecting member are mounted for adjustment;

adjusting the at least one connecting member for alignment with a respective connecting member; and attaching the at least one backsplash and the at least one front edge to the at least one surface member module.

2. The method according to claim 1, further comprising the step of providing a sink module, the sink module being attachable to the at least one surface member module, the at least one backsplash, and the at least one front edge.

3. The method according to claim 2, wherein the at least one surface member module is removably attached to the sink module, and the at least one backsplash and at least one front edge are both removably attached to the at least one surface member module and sink module.

4. The method according to claim 1, wherein the at least one surface member module is removably attached to the at least one backsplash and the at least one front edge.

5. The method according to claim 1, further comprising the step of cutting the at least one surface member module to conform to the desired sized worktop.

6. The method according to claim 1, further comprising the step of providing the at least one surface member module, the at least one backsplash, and the at least one front edge with a plurality of removable attachment members.

7. The method according to claim 1, wherein the worktop extends around a ninety-degree corner.

8. The method according to claim 7, further comprising the step of mitering the at least one backsplash and the at least one front edge to form mitered joints therein at the ninety degree corner.

9. The method according to claim 7, wherein the worktop has exposed side edges and front corners, and further comprising the step of extending the at least one front edge to cover the exposed side edges and mitering the at least one front edge to form a mitered joint at the front corners.

10. The method according to claim 1, wherein the worktop has exposed side edges and front corners, and further comprising the step of extending the at least one front edge to cover the exposed side edges and mitering the at least one front edge to form a mitered joint at the front corners.

11. The method according to claim 1, further comprising the step of providing the at least one backsplash with a location for decorative indicia.

12. The method according to claim 1, further comprising the step of providing each of the at least one surface member module, at least one backsplash, and at least one front edge in a variety of aesthetic designs.

* * * * *